US005279532A

United States Patent [19]

Chen

[11] Patent Number: 5,279,532

[45] Date of Patent: Jan. 18, 1994

[54] EXERCISE DEVICE FOR SIMULATING SKIING EXERCISE

[76] Inventor: Pao-Chiang Chen, No. 3-6, Ching Yang Rd., Liu Pao Village, Ta Ya Hsiang, Taichung Hsien, Taiwan

[21] Appl. No.: 19,107

[22] Filed: Feb. 18, 1993

[51] Int. Cl.[5] ..... A63B 22/00; A63B 21/02

[52] U.S. Cl. ..... 482/71; 482/121; 482/907

[58] Field of Search ..... 482/70, 71, 121-122

[56] References Cited

U.S. PATENT DOCUMENTS

| | | | |
|---|---|---|---|
| 3,650,528 | 3/1972 | Natterer | 482/71 |
| 4,340,214 | 7/1982 | Schutzer | 482/71 |
| 4,650,184 | 3/1987 | Brebner | 482/71 |
| 4,953,853 | 9/1990 | Loane | 482/71 |
| 5,181,894 | 1/1993 | Shieng | 482/70 |
| 5,209,711 | 5/1993 | Scrima | 482/51 |

*Primary Examiner*—Stephen R. Crow

*Attorney, Agent, or Firm*—Peterson, Wicks, Nemer & Kamrath

[57] ABSTRACT

An exercise device includes a post extended upward from a base, a track laterally supported on the base, a pair of foot pedals slidably disposed on the track, four pulleys disposed on the base, and an elastic band engaged over the pulleys and having two ends coupled to the foot pedals respectively. The foot pedals are movable sidewise against the elastic band in order to simulate skiing exercise.

3 Claims, 5 Drawing Sheets

EXERCISE DEVICE FOR SIMULATING SKIING EXERCISE

BACKGROUND OF THE INVENTION

1. Field of the Invention

The present invention relates to an exercise device, and more particularly to an exercise device for simulating skiing exercises.

2. Description of the Prior Art

A typical exercise device for simulating skiing exercise is shown in FIG. 5 and comprises a pair of parallel tracks 90 formed as a base portion, a pair of handles 92 extended upward therefrom, and a foot pedal 94 slidably engaged on each of the tracks 90, the foot pedals 94 are movable forward and rearward and can not move laterally.

The present invention has arisen to mitigate and/or obviate the afore-described disadvantages of the conventional exercise mechanisms.

SUMMARY OF THE INVENTION

The primary objective of the present invention is to provide an exercise device with which the users may simulate sidewise exercising movements of the skiing exercise.

In accordance with one aspect of the invention, there is provided an exercise device comprising a base, a post extended upward from the base, a hand grip provided on top of the post, a track laterally supported on the base, a pair of foot pedals slidably disposed on the track, at least two pulleys disposed on the base, and an elastic band engaged over the pulleys and including two end portions coupled to the foot pedals respectively, the foot pedals being movable sidewise against the elastic band in order to simulate skiing exercise.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
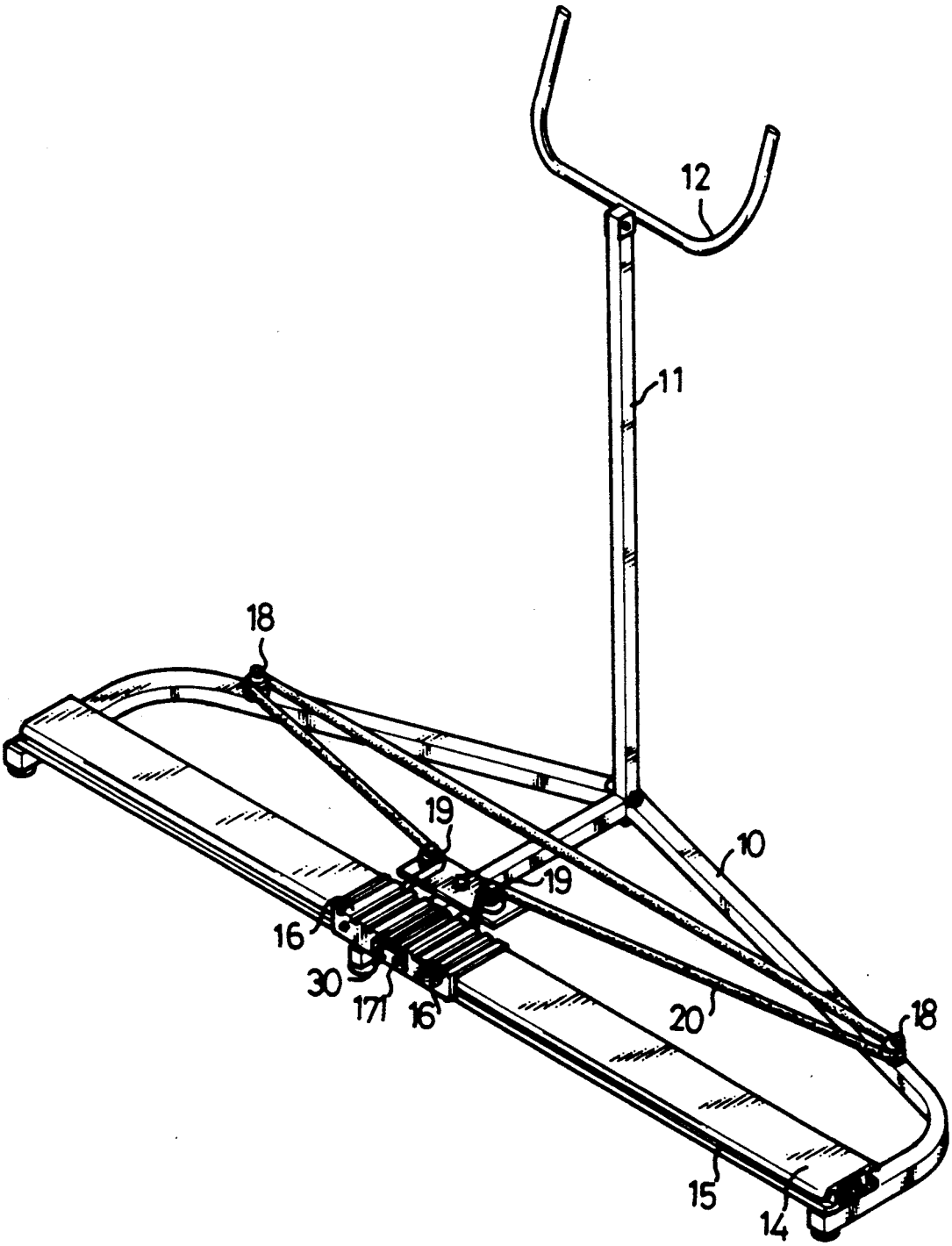
FIG. 1 is a perspective view of an exercise device in accordance with the present invention.
Figure 2:
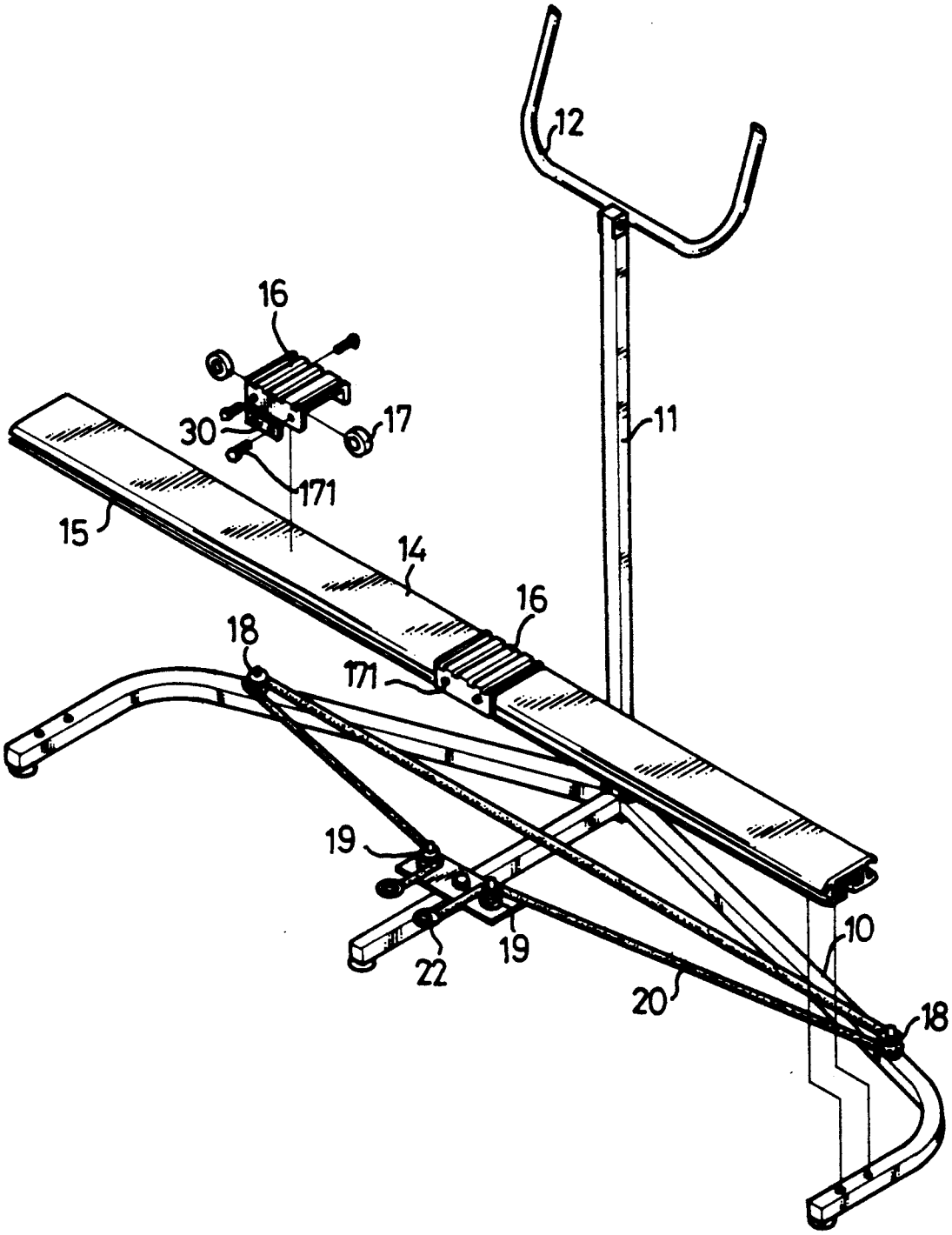
FIG. 2 is an exploded view of the exercise device.
Figure 3:
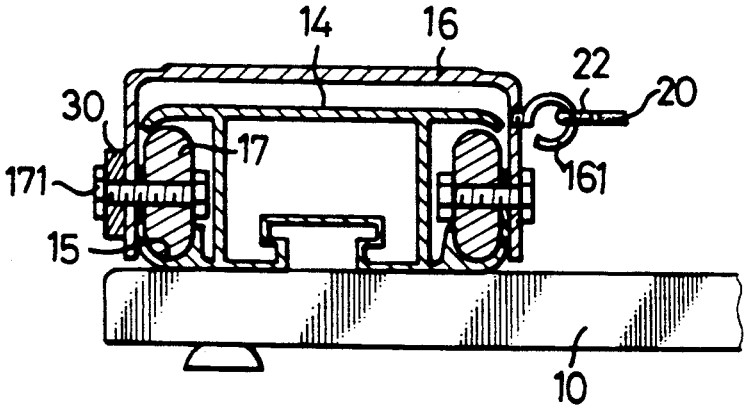
FIG. 3 is a cross sectional view taken along lines 3—3 of FIG. 1.

Referring the drawings and initially to FIGS. 1 to 3, an exercise device comprises a base 10 including a post 11 extended upward therefrom, a hand grip 12 provided on top of the post 11, a track 14 laterally disposed on the base 10 and including a pair of channels 15 oppositely and longitudinally formed in the side portions thereof, a pair of foot pedals 16 slidably engaged on the tracks and each including at least one roller 17 coupled thereto by bolt 171 and slidably engaged in each of the channels 15 of the track 14 such that the foot pedals 16 are freely slidable along the track 14. A hook 161 is fixed to each of the foot pedals 16. A pair of pulleys 18 are oppositely supported on the base 10 and spaced away from each other, another pair of pulleys 19 are disposed in the middle portion of the base 10, and an elastic band 20 engaged over the pulleys 19 and including two end portions each having a ring 22 secured thereon for coupling to the hooks 161 of the foot pedals 16 respectively such that the foot pedals 16 are resiliently coupled together.

Optionally, a coupler 30 is coupled to one of the foot pedals 16 by the bolt 171 and is engageable with the bolt 171 of the other foot pedal 16 such that the foot pedals 16 can be coupled together and such that the foot pedals 16 move in concert.

Figure 4:
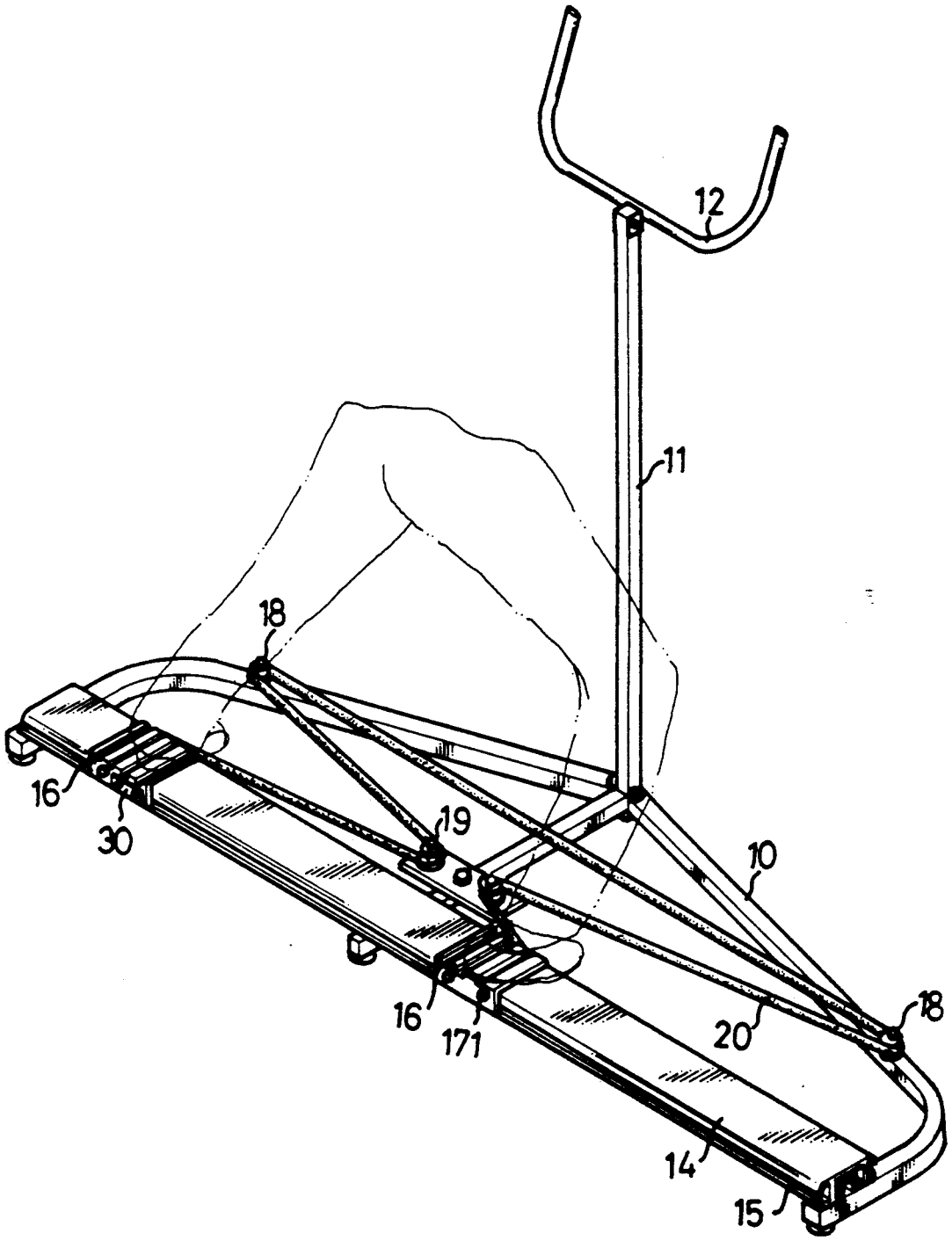
FIG. 4 is a perspective view illustrating the operation of the exercise device.
Figure 5:
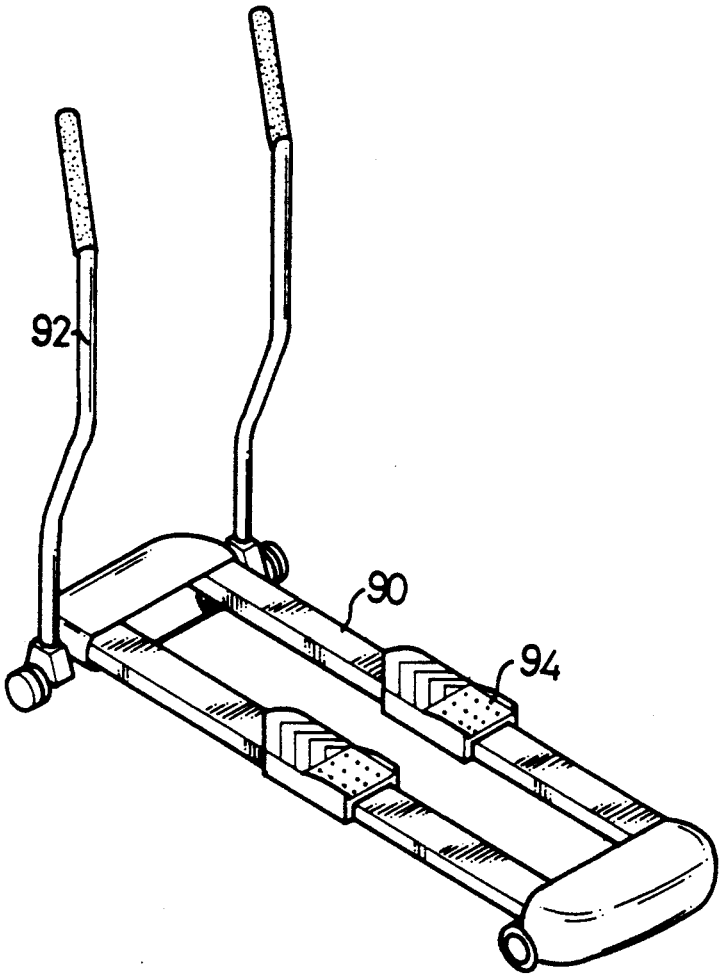
FIG. 5 PRIOR ART
FIG. 5 is a perspective view of a typical exercise device.

In operation, referring next to FIG. 4, the user may force the foot pedals 16 away from each other against the resilience of the elastic band 20 so as to simulate sidewise exercising movements of the skiing exercise. Alternatively, as shown in FIG. 1, the foot pedals 16 can be secured together by the coupler 30 such that the foot pedals 16 move in concert and such that the users may simulate another type of exercising movements.

Accordingly, with the exercise device, the users may simulate sidewise exercising movements of the skiing exercise.

Although this invention has been described with a certain degree of particularity, it is to be understood that the present disclosure has been made by way of example only and that numerous changes in the detailed construction and the combination and arrangement of parts may be resorted to without departing from the spirit and scope of :the invention as hereinafter claimed.

I claim:

1. An exercise device comprising a base, a post extended upward from said base, a hand grip provided on top of said post, a track laterally supported on said base, a pair of foot pedals slidably disposed on said track, at least two pulleys disposed on said base, and an elastic band engaged over said pulleys and including two end portions coupled to said foot pedals respectively, said foot pedals being moved sidewise against said elastic band in order to simulate skiing exercise.

2. An exercise device according to claim 1, wherein said track includes two opposite side portions, and a pair of channels longitudinally formed along said side portions respectively, each of said foot pedals includes at least one roller disposed therein and rotatably engaged in each of said channels of said track, whereby, said foot pedals are freely rotatable along said track.

3. An exercise device according to claim 1 further comprising a coupler pivotally secured to a first of said foot pedals and engageable with a second of said foot pedals so as to couple said foot pedals together, whereby, said foot pedals move in concert.

* * * * *